US007909739B2

(12) United States Patent
Kwon et al.

(10) Patent No.: US 7,909,739 B2
(45) **Date of Patent: *Mar. 22, 2011**

(54) PEDAL EXERCISE MACHINE HAVING ARC TRAJECTORY

(75) Inventors: Taeg Joon Kwon, Seoul (KR); Sang Young Choi, Goyang (KR); Eung Won Kim, Bucheon-si (KR); Sang Seo Han, Incheon (KR); Sang Jun Han, Seoul (KR); Gi Hong Kim, Seoul (KR)

(73) Assignee: Motus Co., Ltd (KR)

( * ) Notice: Subject to any disclaimer, the term of this patent is extended or adjusted under 35 U.S.C. 154(b) by 64 days.

This patent is subject to a terminal disclaimer.

(21) Appl. No.: 12/471,159

(22) Filed: May 22, 2009

(65) Prior Publication Data

US 2009/0291810 A1 Nov. 26, 2009

Related U.S. Application Data

(63) Continuation-in-part of application No. 12/266,389, filed on Nov. 6, 2008, now Pat. No. 7,618,351.

(30) Foreign Application Priority Data

Feb. 18, 2008 (KR) ..... 10-2008-0014594

(51) Int. Cl.
*A63B 22/04* (2006.01)

(52) U.S. Cl. ..... 482/52; 482/57

(58) Field of Classification Search ..... 482/51–53, 482/57, 70, 71, 62; 434/247, 255
See application file for complete search history.

(56) References Cited

U.S. PATENT DOCUMENTS

| | | | | |
|---|---|---|---|---|
| 5,279,529 | A | 1/1994 | Eschenbach | |
| 5,499,956 | A * | 3/1996 | Habing et al. | 482/52 |
| 5,637,058 | A * | 6/1997 | Rodgers, Jr. | 482/51 |
| 5,921,894 | A | 7/1999 | Eschenbach | |
| 5,947,873 | A * | 9/1999 | Sands et al. | 482/52 |
| 6,024,676 | A * | 2/2000 | Eschenbach | 482/51 |
| 6,436,007 | B1 * | 8/2002 | Eschenbach | 482/52 |
| 6,689,021 | B2 | 2/2004 | Stevens | |
| 6,949,054 | B1 * | 9/2005 | Stearns et al. | 482/52 |
| 7,025,710 | B2 | 4/2006 | Corbalis et al. | |
| 7,037,242 | B2 | 5/2006 | Lo et al. | |
| 7,267,638 | B2 | 9/2007 | Wang | |
| 7,618,351 | B2 * | 11/2009 | Kwon et al. | 482/52 |
| 2008/0242516 | A1 * | 10/2008 | Lu et al. | 482/52 |
| 2009/0011904 | A1 * | 1/2009 | Chuang et al. | 482/52 |
| 2009/0291810 | A1 * | 11/2009 | Kwon et al. | 482/52 |

* cited by examiner

*Primary Examiner* — Loan Thanh
*Assistant Examiner* — Daniel F Roland
(74) *Attorney, Agent, or Firm* — Booth Udall, PLC

(57) ABSTRACT

A pedal exercise machine with pedals and arm levers operated in conjunction with each other. A base, a front frame and a center frame are coupled to each other and a pair of pedals move upwards and downwards in alternating directions. Pedal links connect the pedals to the base, arm levers couple to the front frame, and lever link units include a first lever link coupled to the corresponding arm lever and a second lever link connecting the first lever link to the corresponding pedal. Subsidiary pedal links connect the pedals to the center frame, a resistance pulley is provided in the center frame, and a crank having crank arms is coupled to the resistance pulley. A first actuating link is coupled to each pedal link at a predetermined angle. A second actuating link is rotatably coupled at both ends to the first actuating link and the corresponding crank arm.

7 Claims, 14 Drawing Sheets

PEDAL EXERCISE MACHINE HAVING ARC TRAJECTORY

BACKGROUND OF THE INVENTION

1. Field of the Invention

The present invention relates generally to a pedal exercise machine which is constructed such that pedals and arm levers are operated in conjunction with each other, thus enabling a user to exercise all parts of the body—specially, to conduct exercise along a pedal trajectory similar to that when climbing a slope or stairs—and, more particularly, to a pedal exercise machine having an arc trajectory which includes a length adjustment means for adjusting the sizes of trajectories of pedals and arm levers, an angle adjustment means for adjusting the position of the trajectory of the pedals, and a displacement means for adjusting the angle of the pedals relative to the ground in conjunction with the length adjustment means, thus enabling a user to exercise desired parts of the body, thereby obtaining various exercise effects.

2. Description of the Related Art

To date, exercise machines having various trajectories have been disclosed.

Representative examples of exercise machines having vertical (or slightly inclined) linear exercise trajectories were proposed in Korean Utility Model Laid-open Publication No. 20-2000-0000468 (publication date: Jan. 15, 2000), which was entitled "LOWER BODY EXERCISE MACHINE", and in Korean Utility Model Registration No. 20-0277771 (registration date: Feb. 28, 2002), which was entitled "ROCK CLIMBING EXERCISE MACHINE".

An exercise machine having a forward-backward trajectory or a trajectory similar to that when jogging was proposed in Korean Utility Model Registration No. 20-0385412 (registration date: May 20, 2005), which was filed by the applicant of the present invention and is entitled "ELLIPTICAL EXERCISE MACHINE".

Furthermore, an elliptical exercise machine, which enables exercise along an asymmetrical elliptical trajectory, was proposed in Korean Patent Registration No. 10-0499232 (registration date: Jun. 24, 2005), which was entitled "ELLIPTICAL".

In addition, other elliptical exercise machines were proposed in U.S. Pat. No. 6,024,676 (COMPACT CROSS TRAINER EXERCISE APPARATUS), U.S. Pat. No. 6,689,021 (ELLIPTICAL TRAINER), U.S. Pat. No. 7,025,710 (ELLIPTICAL EXERCISE DEVICE AND ARM LINKAGE) and U.S. Pat. No. 7,267,638 (PACE-ADJUSTING MECHANISM OF AN ELLIPTICAL CROSS TRAINER).

Particularly, a technique was proposed in U.S. Pat. No. 2009/0011904 (ELLIPTICAL EXERCISE DEVICE), which provides a longitudinal and horizontal arc trajectory and enables a user to exercise all parts of the body using pedals and hand grips which are operated in conjunction with each other.

As exercise machines having various exercise trajectories have been developed and improved, the applicant of the present invention proposes a further improved exercise machine, particularly, one having an exercise trajectory similar to that when a person climbs a slope or stairs.

In particular, the applicant of the present invention proposes a pedal exercise machine having an arc trajectory which is constructed such that trajectories of pedals and lever arms are adjustable, the positions of the trajectories of the pedals and lever arms are adjustable, and the angle of the pedals relative to the ground is adjustable, thus providing various exercise effects.

SUMMARY OF THE INVENTION

Accordingly, the present invention has been made keeping in mind the above problems occurring in the prior art, and an object of the present invention is to provide a pedal exercise machine having an arc trajectory which is constructed such that pedals and arm levers are operated in conjunction with each other, thus enabling a user to exercise all parts of the body—specially, to conduct exercise along a pedal trajectory similar to that when climbing a slope or stairs.

Another object of the present invention is to provide a pedal exercise machine having an arc trajectory which includes a length adjustment means for increasing or reducing the lengths of trajectories of pedals and arm levers to correspond to the height of a user and the length of the arms of the user.

A further object of the present invention is to provide a pedal exercise machine having an arc trajectory which includes an angle adjustment means for adjusting the position of the trajectory of the pedals, thus providing various exercise effects.

Another further object of the present invention is to provide a pedal exercise machine having an arc trajectory which includes a displacement means for adjusting the angle of the pedals relative to the ground along with the length adjustment means, so that the exercise posture of the user, in particular, the position of the ankles of the user, can be easily changed.

In order to accomplish the above objects, in an aspect, the present invention provides a pedal exercise machine having an arc trajectory, including: a base; a front frame and a center frame provided on the base, the front frame and the center frame being coupled to each other; a pair of pedals to move upwards and downwards in alternating directions; a pair of pedal links for connecting respectively each of the pedals to the base; a pair of arm levers coupled to the front frame so as to be rotatable in alternating directions; a pair of lever link units each having a first lever link coupled at a first end thereof to the corresponding arm lever, and a second lever link connecting a second end of the first lever link to the corresponding pedal, the second lever link being coupled to the pedal by a shaft that couples the corresponding pedal link to the corresponding pedal; a pair of subsidiary pedal links connecting respectively the pedals to the center frame, each of the subsidiary pedal links being coupled to the pedal by a shaft different from the shaft, through which the corresponding pedal link is coupled to the corresponding pedal; a resistance pulley provided in the center frame; a crank having crank arms coupled to the resistance pulley through a crank shaft; a first actuating link integrally coupled to each of the pedal links at a predetermined angle; and a second actuating link rotatably coupled at both ends thereof to the first actuating link and the corresponding crank arm of the crank.

The first actuating link may have an angle adjustment means for adjusting an angle between the first actuating link and the corresponding pedal link around a base-side shaft of the pedal link.

Each of the crank arms of the crank may have a length adjustment means.

Each of the subsidiary pedal links may have a displacement means for displacement thereof relative to the corresponding pedal.

The displacement means may be constructed such that an angle of the pedal relative to a ground varies depending on position, at which the subsidiary pedal link is coupled to the center frame, the pedals, or both the center frame and the pedal.

The displacement means may be constructed such that the subsidiary pedal link comprises two separate bodies coupled to each other so as to be adjustable in length.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Hereinafter, a preferred embodiment of the present invention will be described in detail with reference to the attached drawings.

Figure 1:
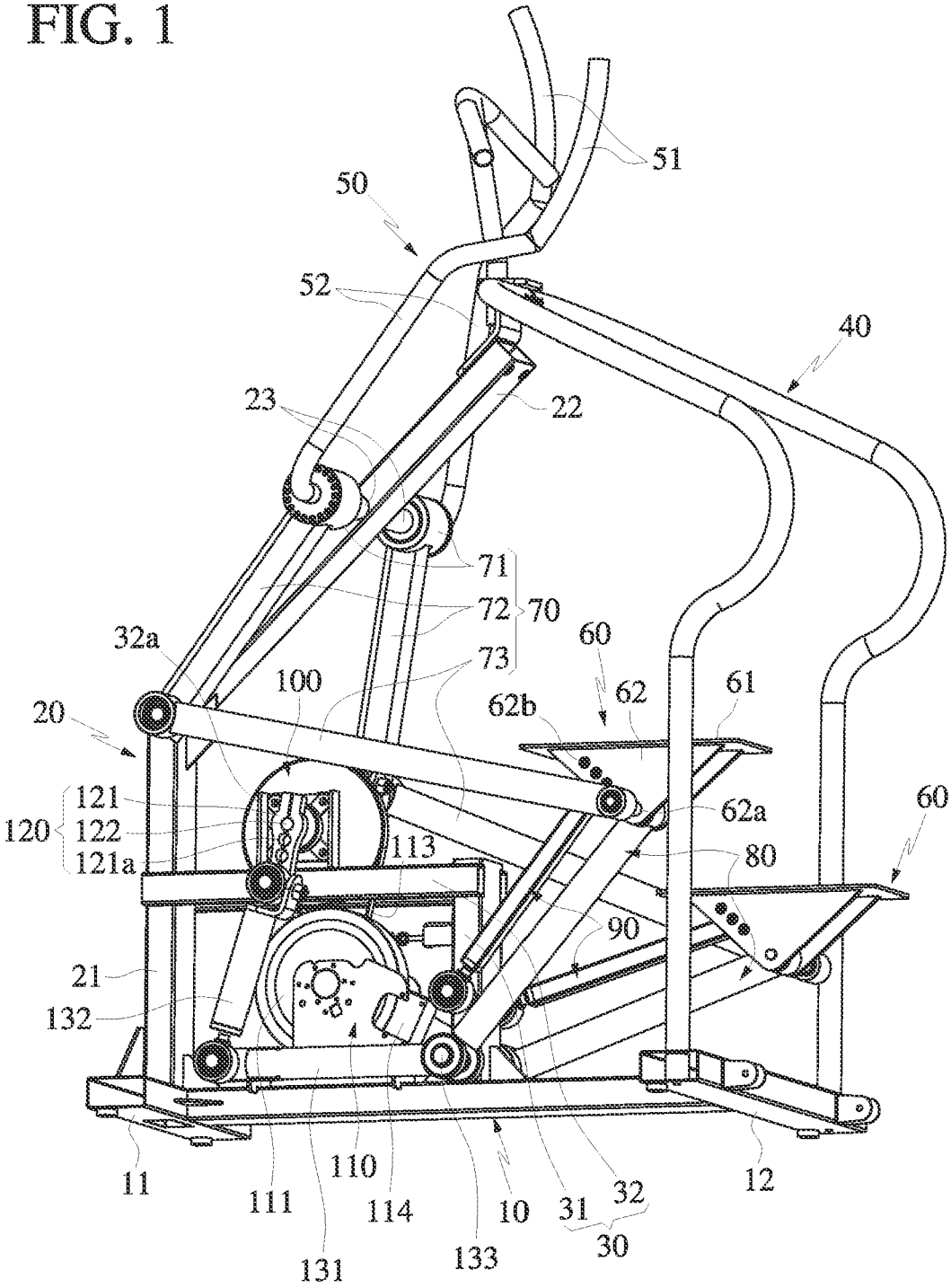
FIG. 1 is a perspective view showing a pedal exercise machine having an arc trajectory, according to an embodiment of the present invention.
Figure 2:
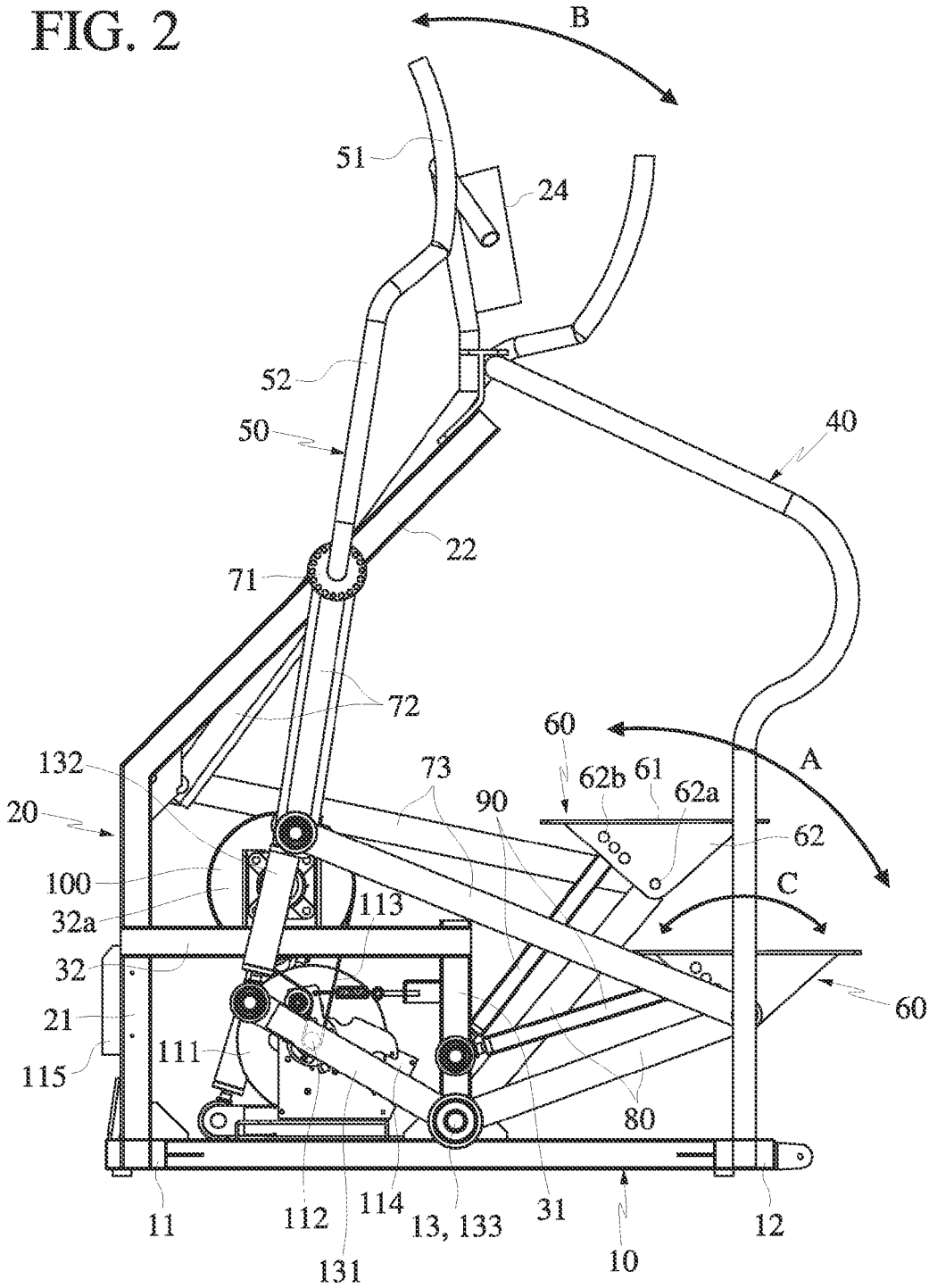
FIG. 2 is a side view showing the pedal exercise machine according to the present invention.
Figure 3:
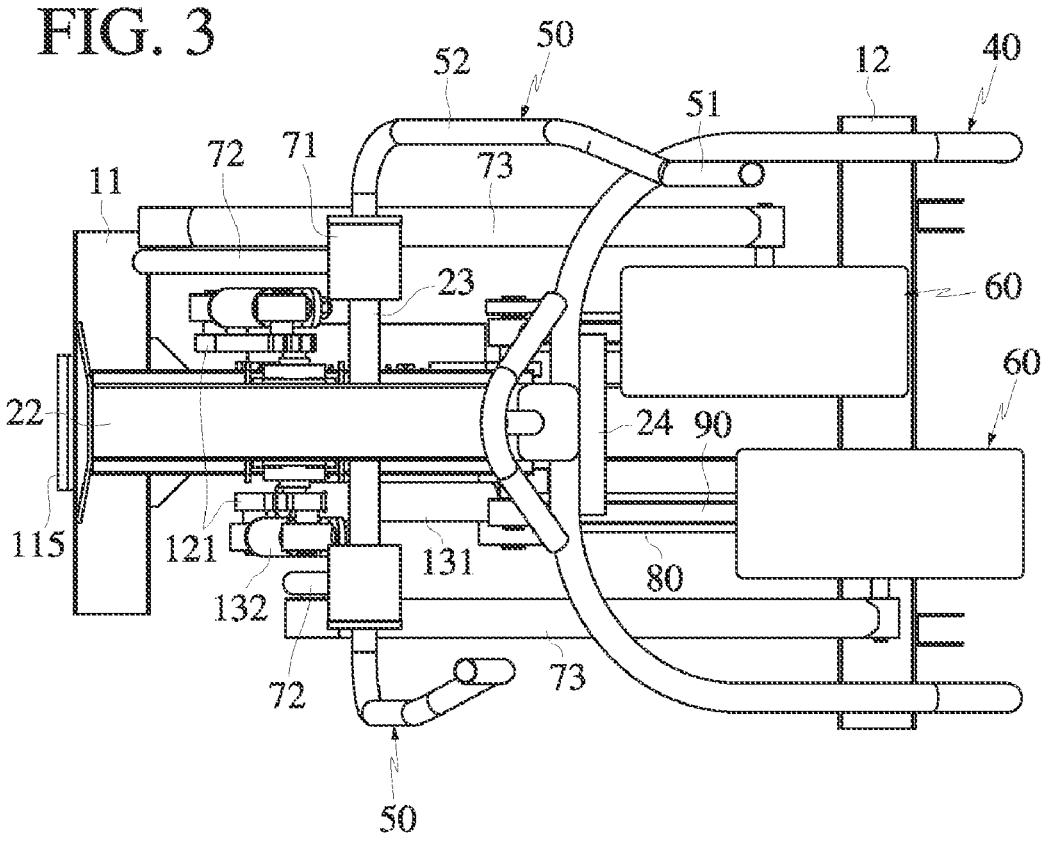
FIG. 3 is a plan view showing the pedal exercise machine according to the present invention.
Figure 4:
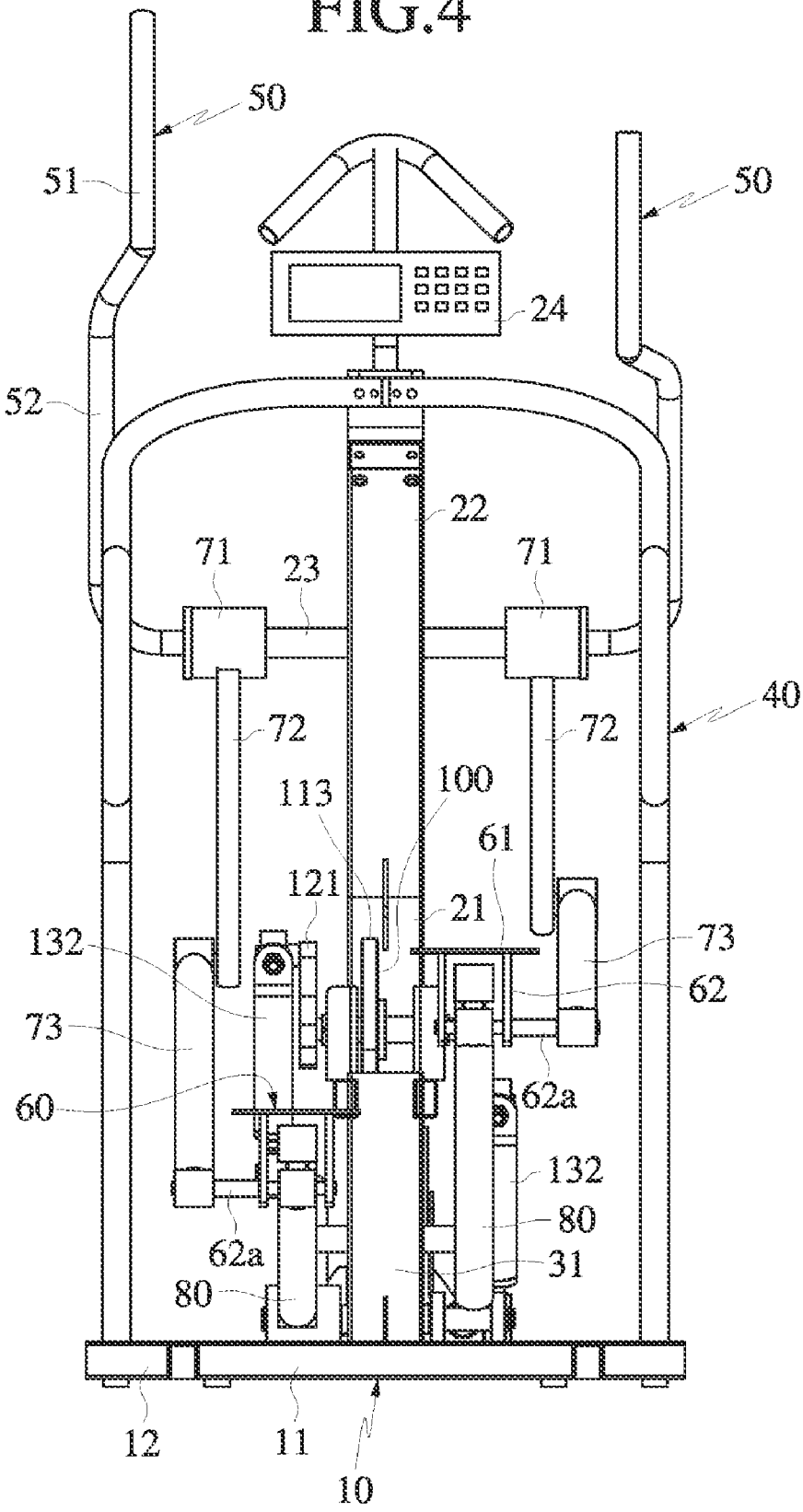
FIG. 4 is a rear view showing the pedal exercise machine according to the present invention.
Figure 5:
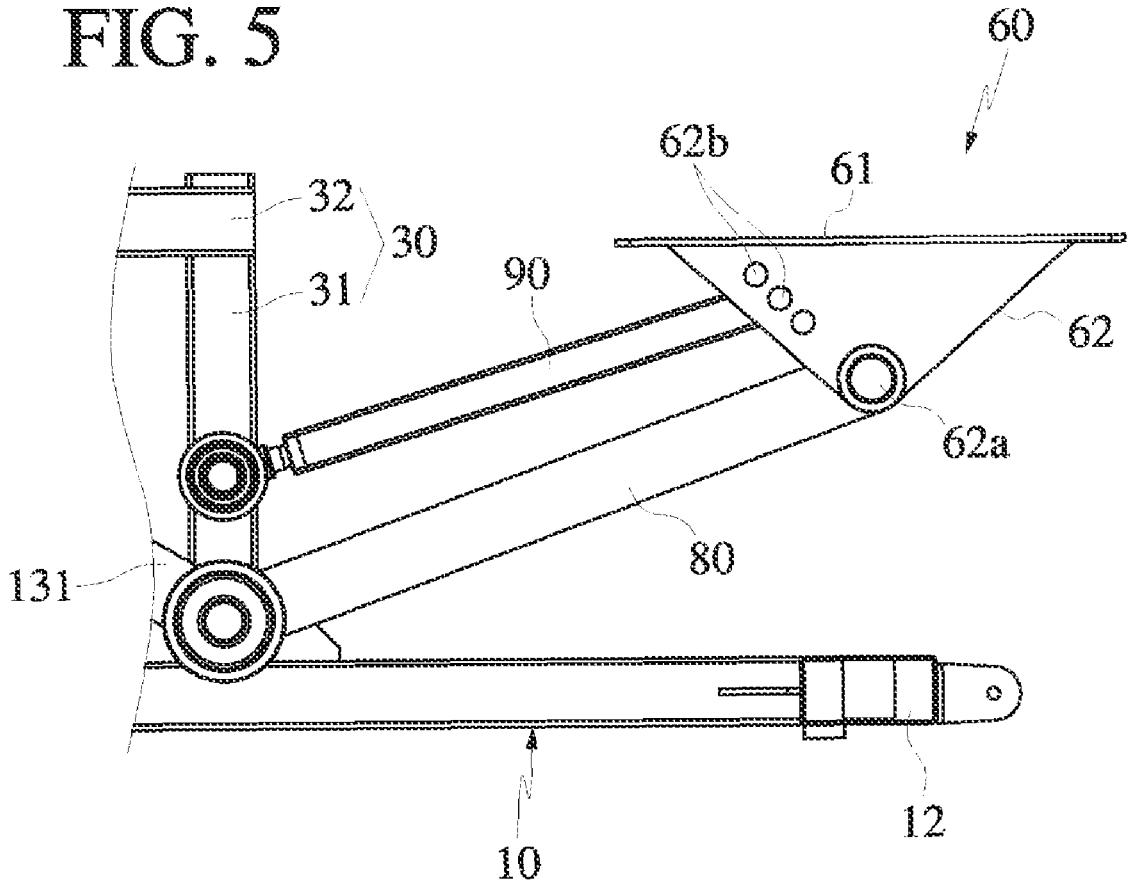
FIGS. 5 and 6 are views showing a displacement means for adjusting the angle of a pedal relative to the ground according to the present invention.
Figure 6:
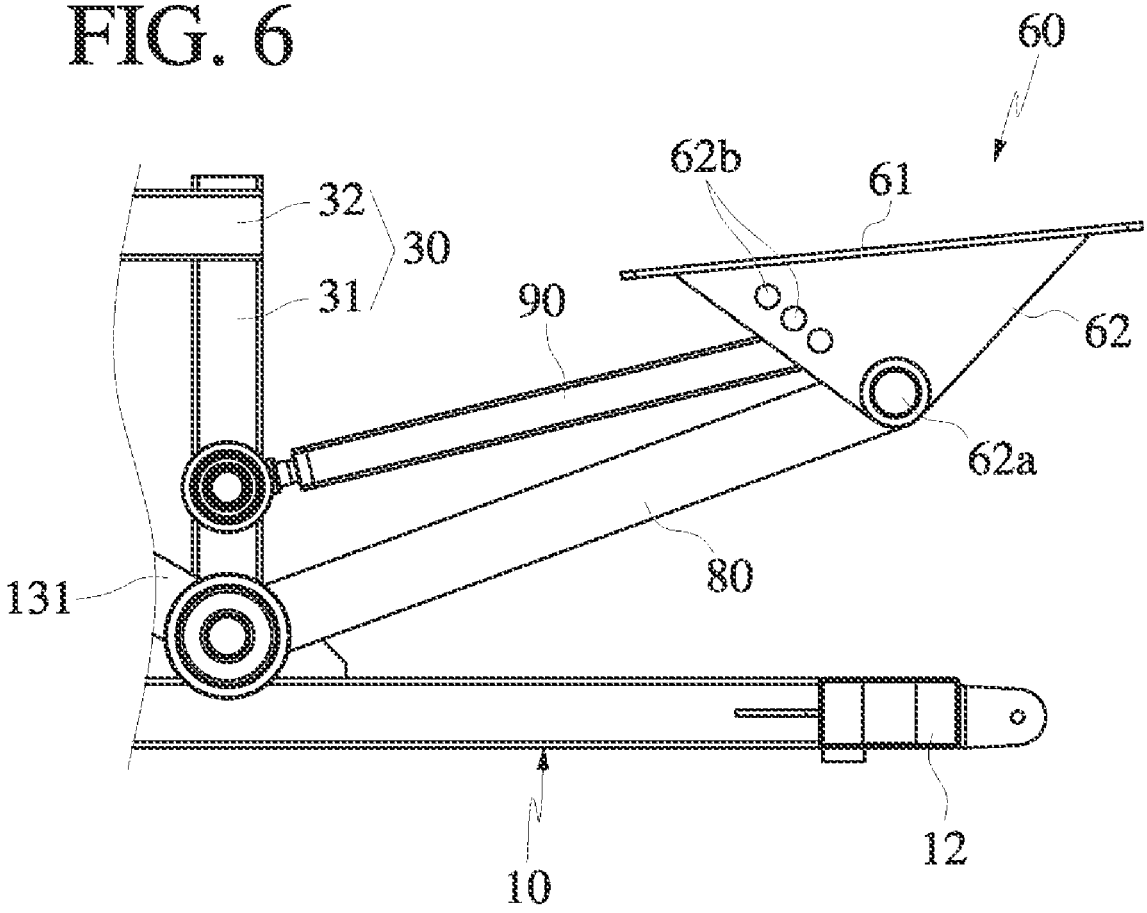
Figure 7:
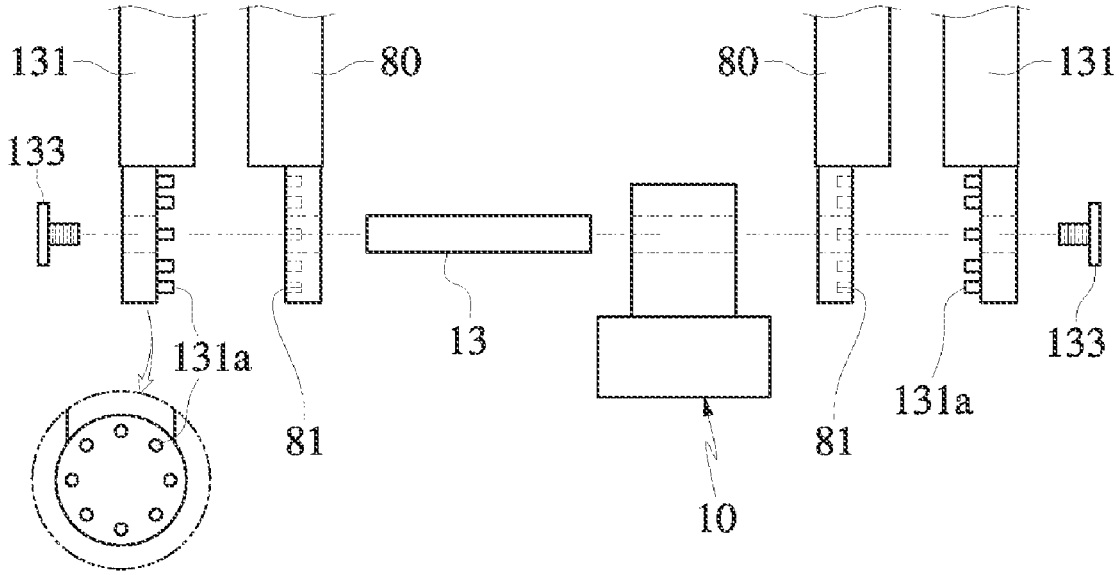
FIG. 7 is a view showing an angle adjustment means of the pedal exercise machine according to the present invention.
Figure 8:
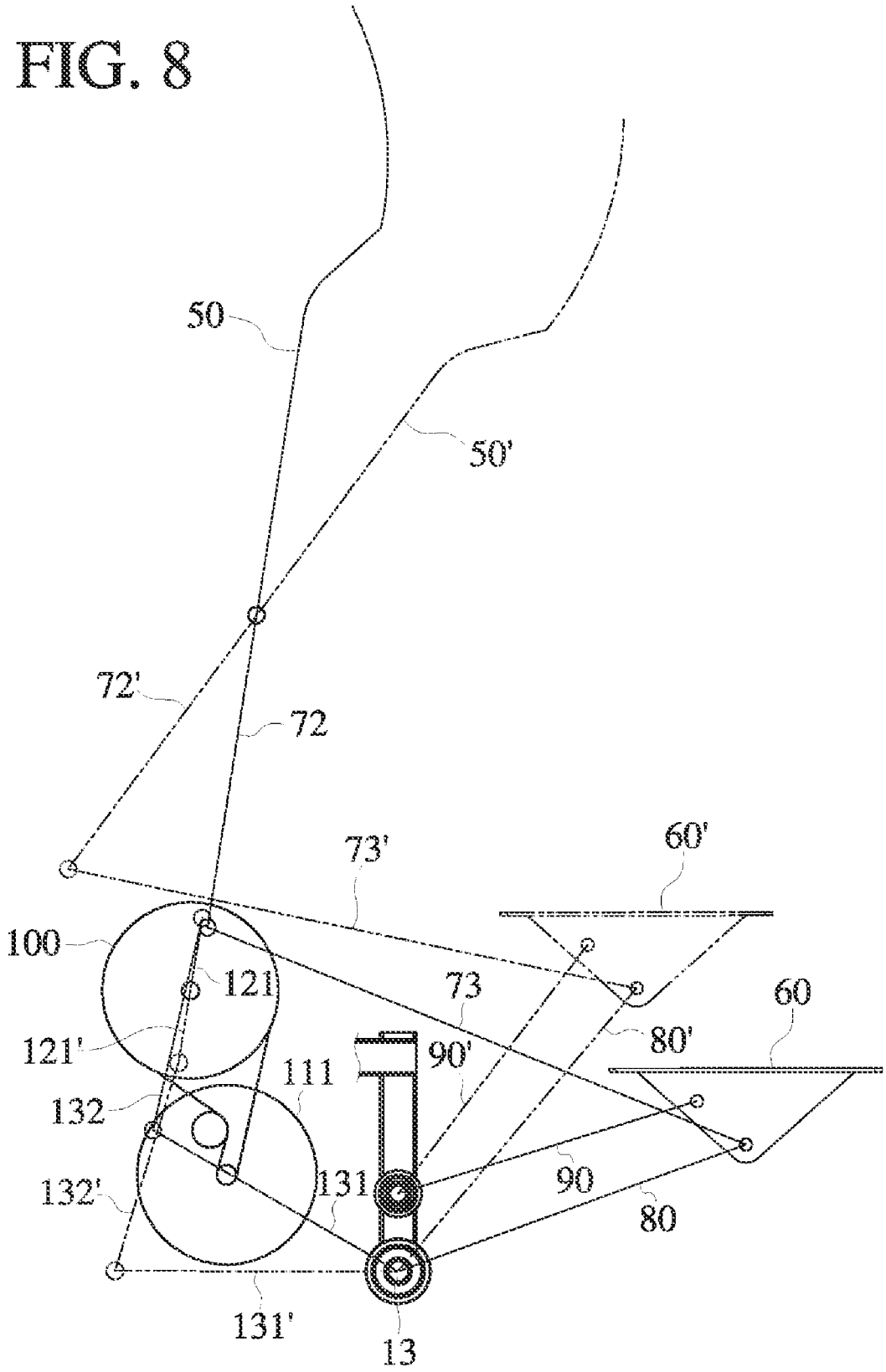
FIGS. 8 and 9 are schematic views showing the operation of pedals and arm levers of the pedal exercise machine according to the present invention.
Figure 9:
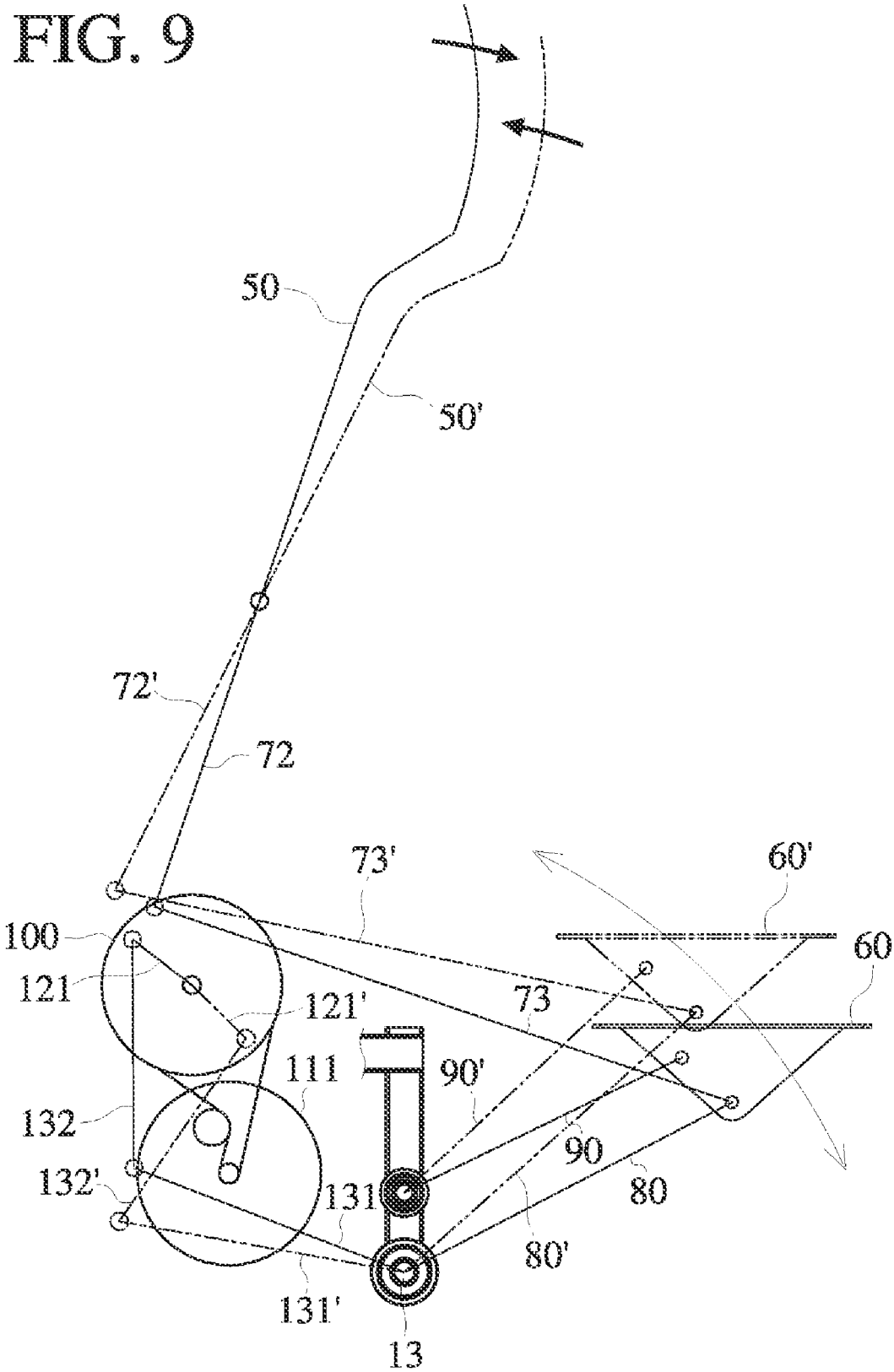
Figure 10:
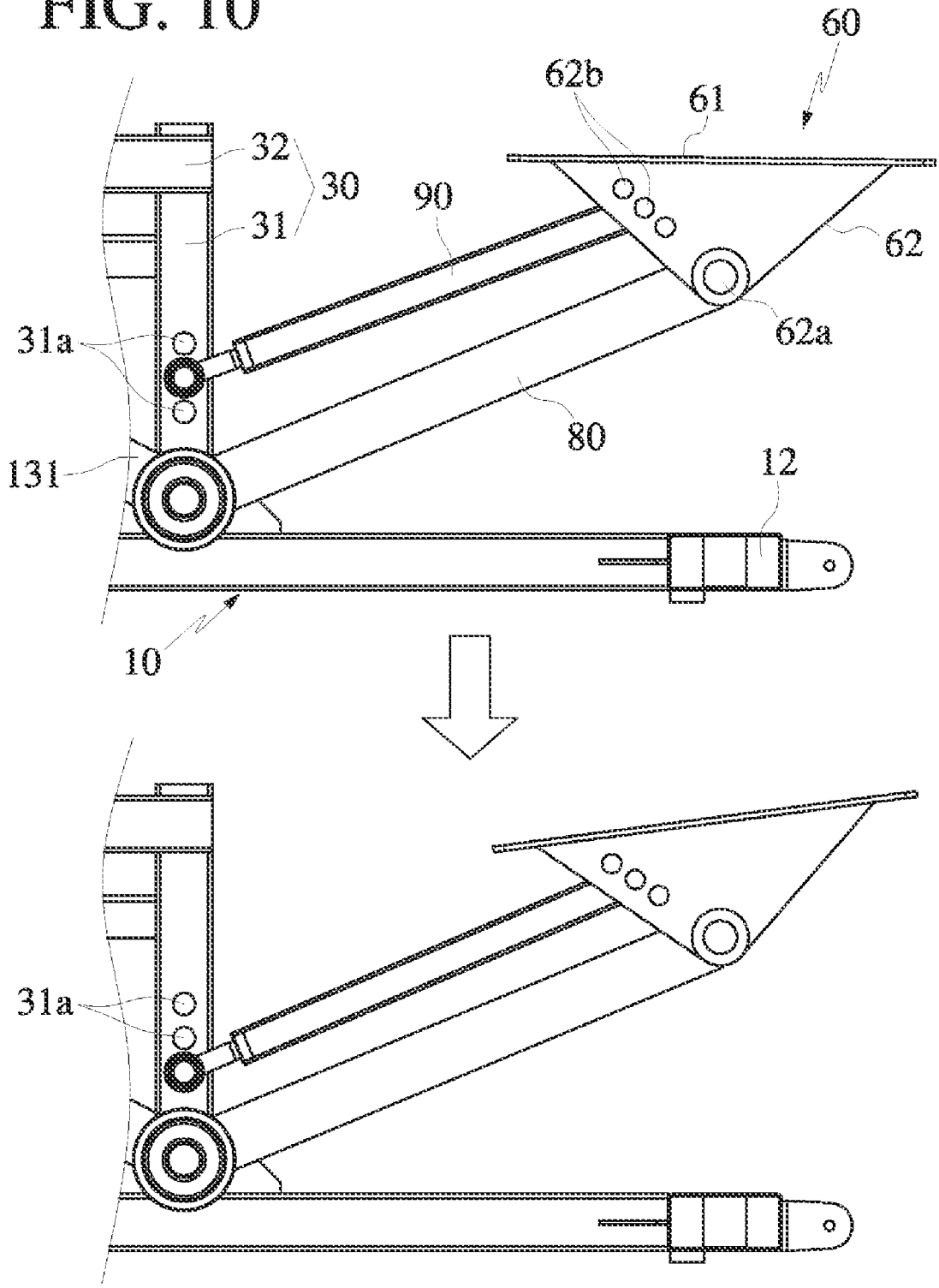
FIG. 10 is views illustrating a type of displacement means in which the position of a link is changed.
Figure 11:
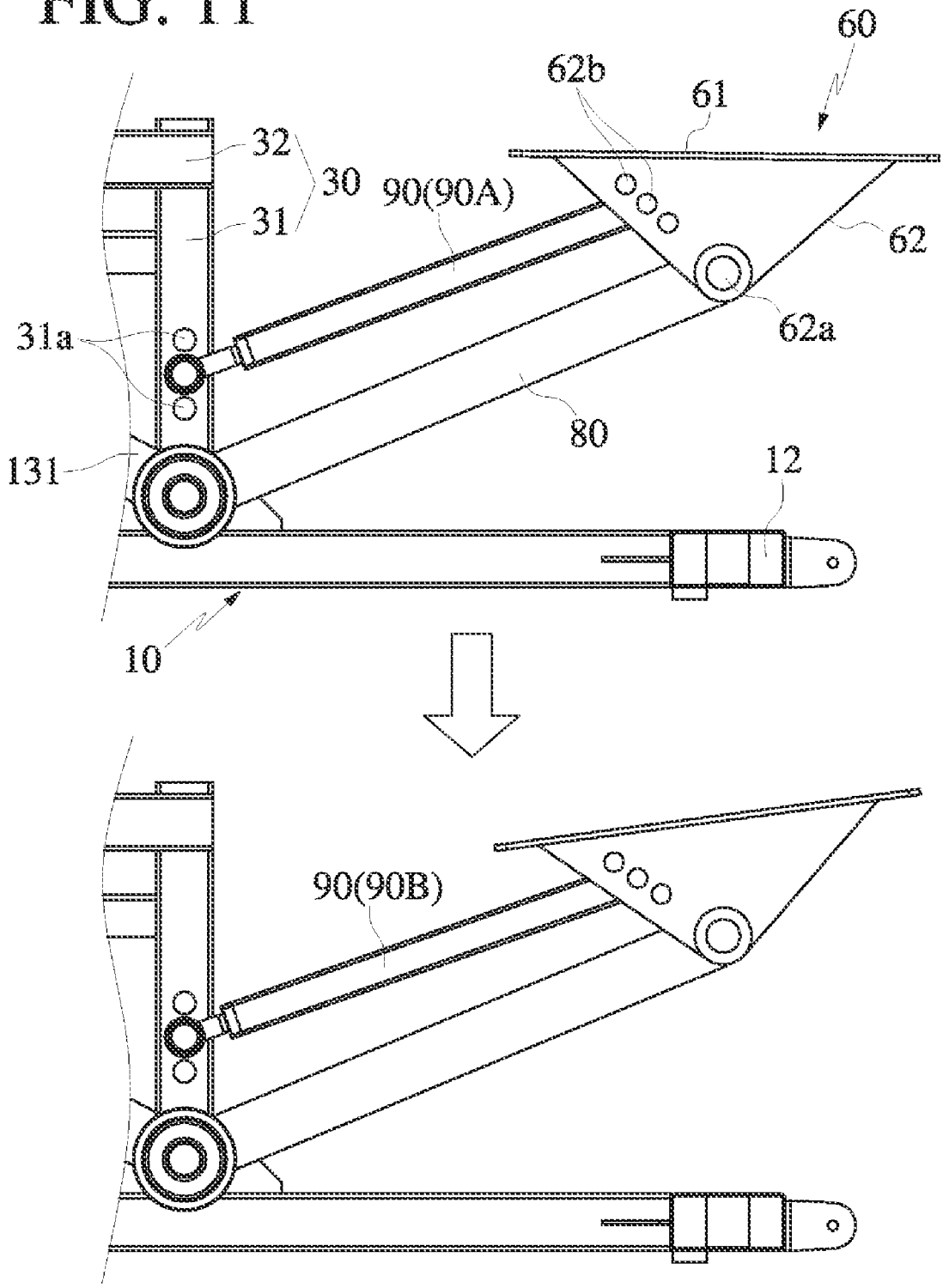
FIG. 11 is views illustrating a type of displacement means in which the length of the link is adjusted.
Figure 12:
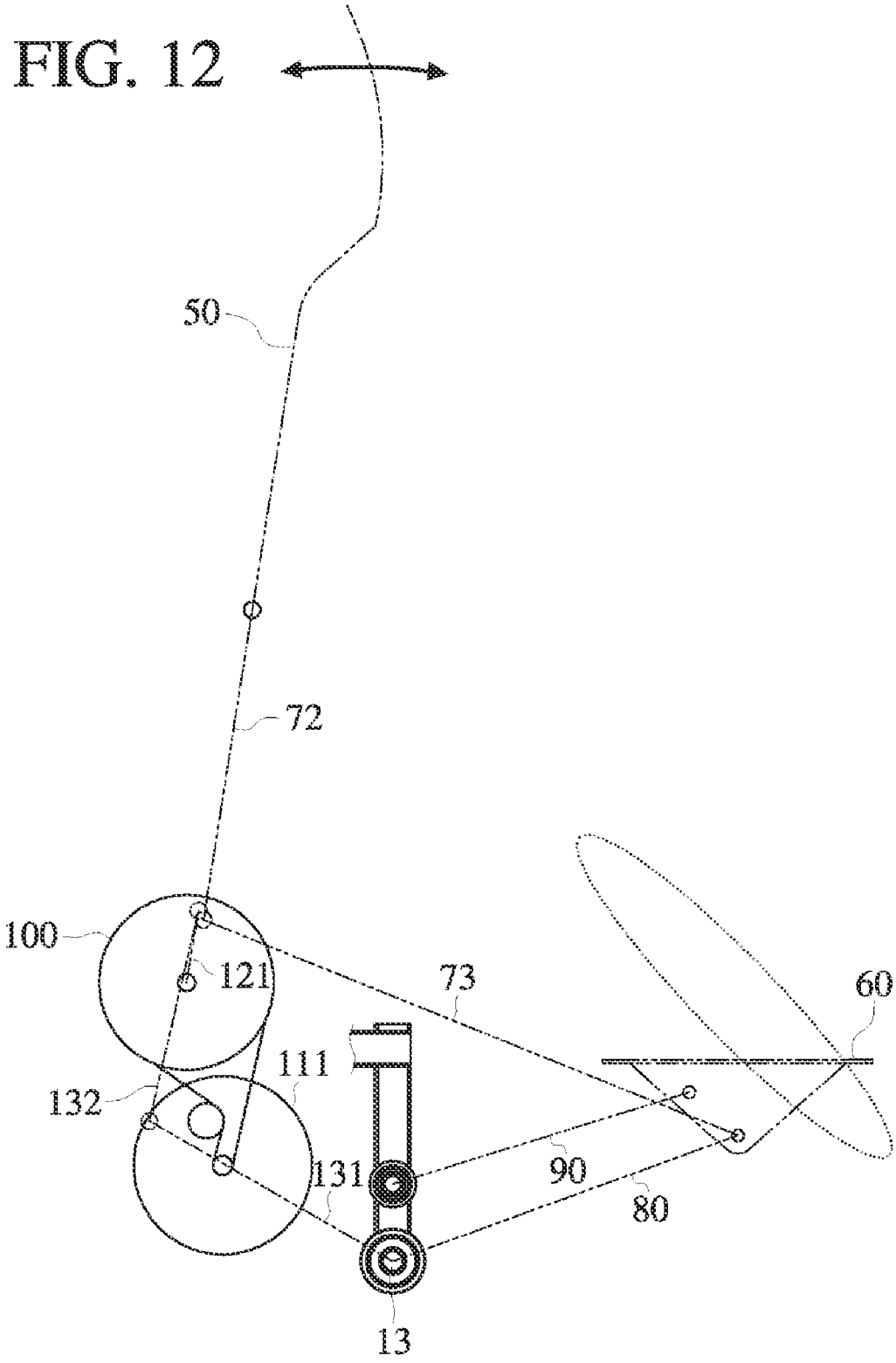
FIGS. 12 through 14 are schematic views showing the operation of one pedal and one arm lever of the pedal exercise machine according to the present invention.
Figure 13:
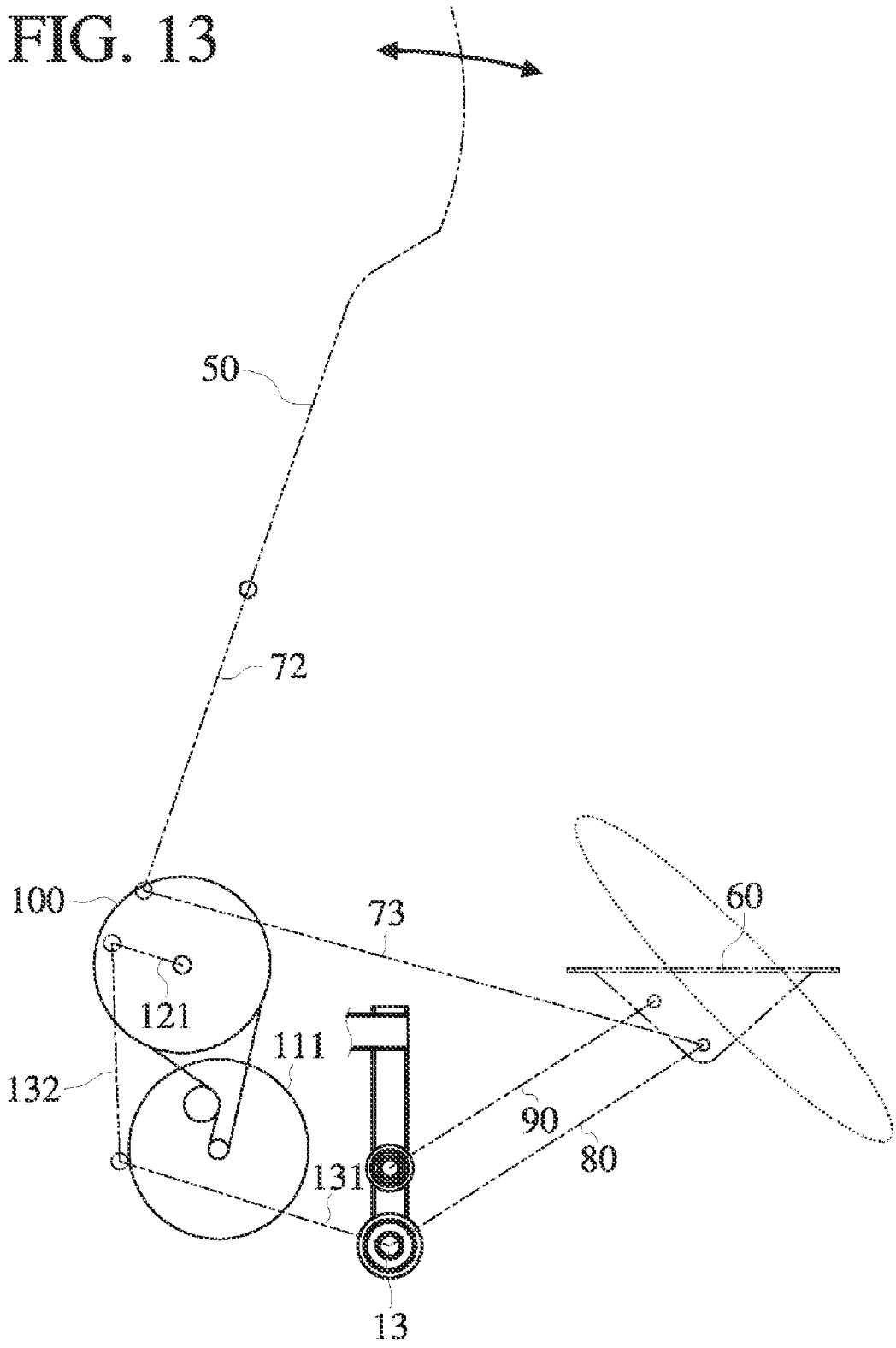
Figure 14:
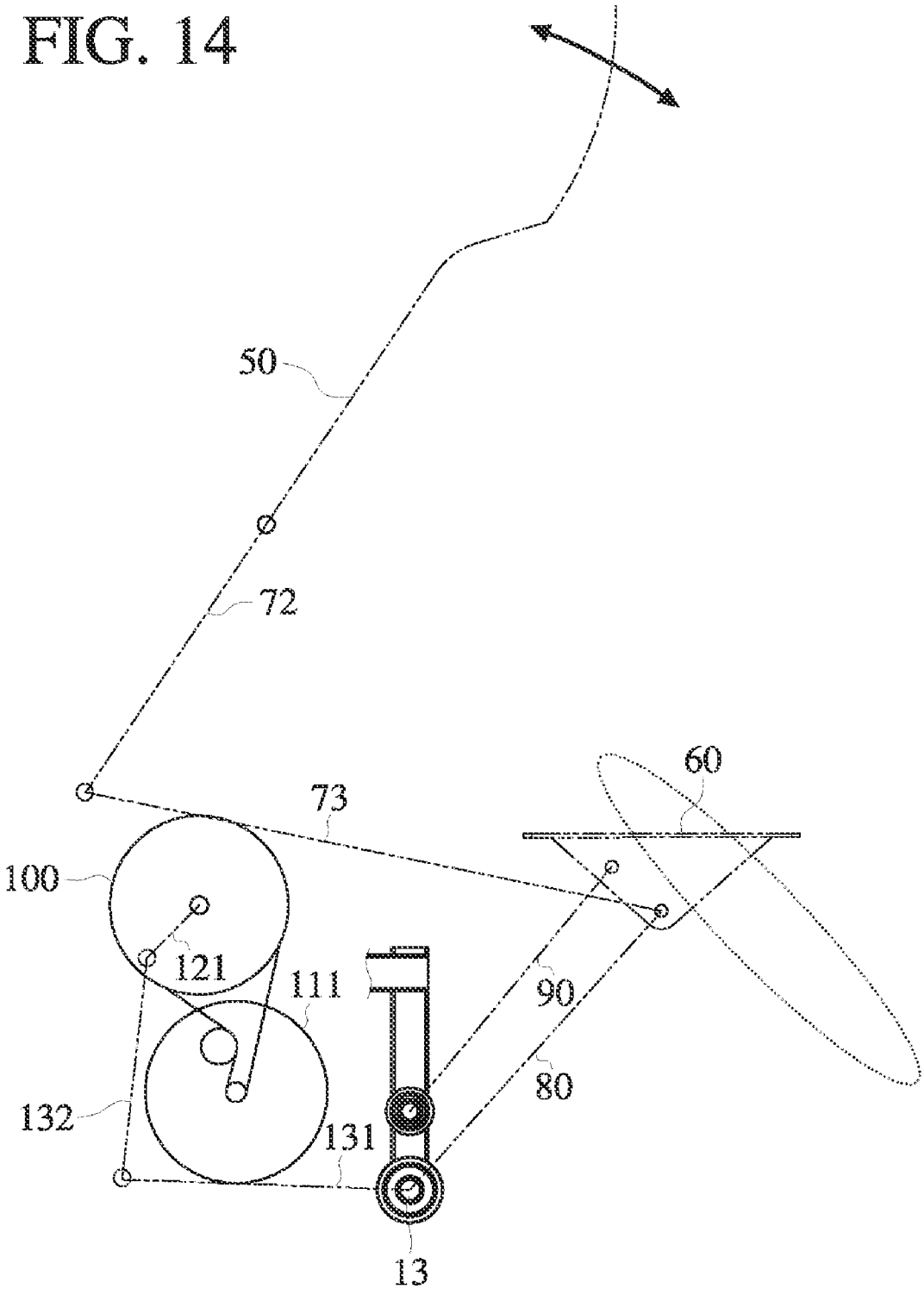

FIG. 1 is a perspective view showing a pedal exercise machine having an arc trajectory, according to an embodiment of the present invention. FIG. 2 is a side view showing the pedal exercise machine according to the present invention. FIG. 3 is a plan view showing the pedal exercise machine according to the present invention. FIG. 4 is a rear view showing the pedal exercise machine according to the present invention. FIGS. 5 and 6 are views showing a displacement means for adjusting the angle of a pedal relative to the ground according to the present invention. FIG. 7 is a view showing an angle adjustment means of the pedal exercise machine according to the present invention. FIGS. 8 and 9 are schematic views showing the operation of pedals and arm levers of the pedal exercise machine according to the present invention. FIG. 10 is a view illustrating a type of displacement means in which the position of a link is changed. FIG. 11 is a view illustrating a type of displacement means in which the length of the link is adjusted. FIGS. 12 through 14 are schematic views showing the operation of one pedal and one arm lever of the pedal exercise machine according to the present invention.

In the description of the present invention, FIGS. 8 and 9 illustrate two positions of elements depending on the operation of the pedal exercise machine. Here, the states of the elements at one of the two positions are designated by the solid lines, and the states of the elements at the other of the two positions are designated by the double-dot-dashed lines. Furthermore, the same reference numerals between the solid lines and the double-dot-dashed lines denote the same elements. For convenience of description, a separate mark (') is added at the end of each reference numeral, which indicates a corresponding double-dot-dashed line.

Furthermore, in FIGS. 12 through 14, the arc trajectory section of the pedal is designated by a dotted line.

As shown in FIGS. 1 through 14, the pedal exercise machine according to the present invention includes a base 10, a front frame 20, a center frame 30, a rear frame 40, arm levers 50, pedals 60, lever link units 70, pedal links 80, subsidiary pedal links 90, a resistance pulley 100, a braking means 110, a crank 120, first actuating links 131 and second actuating links 132.

1) Base 10

The base 10 has a predetermined length and is provided at respective opposite ends thereof with first and second support members 11 and 12. The base 10 has a shaft 13 in a medial portion thereof.

2) Front Frame 20

The front frame 20 includes a first frame 21, which is provided on the first support member 11 of the base 10 and has a predetermined height, and a second frame 22, which extends from the first frame 21 rearwards and is inclined upwards at a predetermined angle. The front frame 20 further includes a control panel 23, which is provided on the second frame 22 to indicate various kinds of information and enable a user to control the operation of the pedal exercise machine.

Here, the control panel 23, the braking means 110 and a power controller 24, which will be explained later herein, are connected to each other through a wired or wireless communication method.

Furthermore, a sensor (not shown) for counting the number of revolutions of the pedals is provided in the resistance pulley 100 or the braking means 110. The sensor serves to measure the number of repetitions of an exercise conducted by the user or the time for which the user exercises. The information obtained by the sensor is transmitted to the control panel 23.

3) Center Frame 30

The center frame 30 includes a vertical frame 31, which is coupled to the upper surface of the base 10, and a horizontal frame 32, which is coupled both to the vertical frame 31 and to the first frame 21 of the front frame 20.

4) Rear Frame 40

The rear frame 40 serves as a reinforcement and to ensure the safety of the user. In addition, the rear frame 40 serves to help the user step onto the pedals 60 and as a handle when the user exercises.

The rear frame 40 is coupled at a first end thereof to the second frame 22 of the front frame 20 and is coupled at a second end thereof to the second support member 12 of the base 10.

5) A Pair of Arm Levers 50

The arm levers 50 are operated in conjunction with the pedals 60 and are coupled to the front frame 20 so as to be rotatable in alternating directions with respect to the front frame 20.

Each arm lever 50 includes a handle 51, which is held by the user, a connection part 52, which extends from the handle 51 and is bent, and a mounting part 52, which extends from the connection part 52, is bent, and is rotatably coupled to the second frame 22 of the front frame 20.

Therefore, depending on the vertical movement of the pedals 60, the arm levers 50 are operated in conjunction with the pedals 60. Furthermore, when the arm levers 50 are alternately moved forwards and backwards, the pedals 60 are operated in conjunction with the arm levers 50. At this time, the arm levers 50 and the pedals 60 are respectively moved along the trajectories B and A, similar to those of the arms and legs of a person when climbing a slope or stairs in an upright walking manner.

6) A Pair of Pedals 60

The pedals 60 are alternately moved upwards and downwards.

Each pedal 60 includes a footboard 61, and a pedal bracket 62, which is mounted to the lower surface of the footboard 61 and has a pedal shaft 62*a* in the center of the lower end thereof.

Here, an anti-slip means (not shown) may be provided on the upper surface of each footboard 61.

As examples of the anti-slip means, a plurality of protrusions may be provided on the upper surface of each footboard 61 in the shape of the sole of a foot of a person, or, alternatively, a depression having a shape corresponding to the sole of a foot of a person may be formed in the upper surface of each footboard 61.

7) A Pair of Lever Link Units 70

The lever link units 70 connect the arm levers 50 to the corresponding pedals 60.

Each lever link unit 70 includes a coupling member 71, which is rotatably fitted over the mounting part of the corresponding arm lever 50, a first lever link 72, which is fastened to the coupling member 71, and a second lever link 73, opposite ends of which are respectively coupled to the first lever link 72 and the pedal shaft 62*a* of the corresponding pedal 60.

8) A Pair of Pedal Links 80

The pedal links 80 connect the corresponding pedals 60 to the base 10. The pedal links 80 are rotatably coupled to corresponding pedals 60 by the identical shafts, through which the lever link units 70 are coupled to the pedals 60.

In detail, the pedal links 80 are rotatably coupled at first ends thereof to the pedal shafts 62*a* of the corresponding pedal brackets 62, and are rotatably coupled at second ends thereof to the shaft 13 of the base 10.

9) A Pair of Subsidiary Pedal Links 90

The subsidiary pedal links 90 are coupled between the center frame 30 and the corresponding pedals 60. The subsidiary pedal links 90 are coupled to the corresponding pedals 60 by shafts that are different from the shafts through which the pedal links 80 are coupled to the pedals 60.

In detail, the subsidiary pedal links 90 are rotatably coupled at first ends thereof to the vertical frame 31 of the center frame 30 and are rotatably coupled at second ends thereof to the pedal brackets 62 of the corresponding pedals 60 by shafts different from the shafts for the pedal links 80.

Furthermore, each subsidiary pedal link 90 has a displacement means with respect to the pedals 60.

As the displacement means, first displacement adjusting holes 62*b* are formed in each pedal bracket 62 at positions spaced apart from the pedal shaft 62*a*, and are arranged in a diagonal direction, and the second end of the subsidiary pedal link 90 is rotatably coupled to one of the first displacement adjusting holes 62*b*. Thus, as shown in FIGS. 5 and 6, the angle C of the pedal 60 with respect to the ground can be adjusted.

The above-mentioned construction of the displacement means is only one representative example, and various modifications or substitutions thereof are possible.

The displacement means is constructed such that the angles of the pedals 60 relative to the ground vary depending on positions at which the subsidiary pedal links 90 are coupled to the vertical frame 31 of the center frame 30, the pedals 60 or both the center frame 30 and the pedals 60.

In addition, in the displacement means, each subsidiary pedal link 90 may comprise two separate bodies (not shown), which are coupled to each other in an insert coupling manner such that the length of the subsidiary pedal link 90 is adjustable.

For example, referring to FIG. 10, the displacement means may further include second displacement adjusting holes 31*a*, which are formed in the vertical frame 31, and to one of which each subsidiary pedal link 90 is rotatably coupled, such that the positions of subsidiary pedal links 90 can be adjusted.

Furthermore, referring to FIG. 11, the displacement means may have a telescope type structure such that the length of each subsidiary pedal link 90 is adjustable (for example: one of a pair of link rods (bodies) is slidably inserted into a remaining one of the pair of link rods (bodies) so that the two link rods are fixed to each other using a screw or the like after the length thereof is adjusted).

Alternatively, the displacement means may have a structure such that several subsidiary pedal links (90: 90A, 90B) having various lengths are prepared and a link having a desired length is selected and used.

Described above, the first displacement adjusting holes 62*b*, the second displacement adjusting holes 31*a*, the subsidiary pedal links 90, which are adjustable in length, or the set of several subsidiary pedal links (90: 90A, 90B) having various lengths may be independently used, or, alternatively, at least two kinds of means may be used together.

The displacement means, which can have the above-mentioned various modifications or substitutions, makes it possible to adjust the angles of the pedals 60 with respect to the ground for the purpose of biomechanics or for the convenience of the user.

10) Resistance Pulley 100

The resistance pulley 100 is mounted to a mounting bracket 32*a*, which is provided on the horizontal frame 32 of the center frame 30.

The resistance pulley 100 enables to move the pedals 60, which are operated in conjunction with the corresponding arm levers 50, upwards and downwards in alternating directions.

11) Braking Means 110

The braking means 110 serves to brake the rotation of the resistance pulley 100, and includes a braking rotary member 111, which is provided on the upper surface of the base 10, a connection shaft 112, which is integrally provided in the center of the braking rotary member 111, and a connection belt 113, which connects the resistance pulley 100 to the connection shaft 112. The braking means 110 further includes a braking operation member 114, which is provided adjacent to the circumferential outer surface of the braking rotary member 111 to electromagnetically or mechanically brake the braking rotary member 111 in response to a control signal transmitted from the control panel 23, and a power control unit 114, which supplies power having a predetermined intensity to operate the braking operation member 114.

A control signal is transmitted from the control panel 23 to the power control unit 115. Thereafter, the control signal is transmitted to the braking operation member 114 and the braking rotary member 111, so that the user who pedals the pedals 60 can adjust exercise intensity. That is, under the control of the power control unit 115, the exercise intensity is determined by the degree to which the braking operation member 114 contacts or releases the braking rotary member 111, and thus compresses or decompresses it. To prevent rapid starting or rapid braking, it is preferable that the power control unit 115 control the braking operation member 114 such that it slowly compresses or decompresses the braking rotary member 111.

12) Crank 120

The crank 120 comprises crank arms 121 which are coupled to the center of the resistance pulley 100 through a crank shaft 122.

Each crank arm 121 has a length adjustment means for adjusting a length from a connection point between the second actuating link 132 and the crank arm 121 to the crank shaft 122.

In the length adjustment means, several shaft holes 121*a* are formed in the one end of each crank arm 121, and are arranged in the longitudinal direction of the crank arm 121. A bearing (not shown) may be provided in each shaft hole 121*a* to prevent noise attributable to friction.

Depending on which shaft hole 121*a* the crank shaft 122 is fitted into, the distance between the crank shaft 122 to the connection portion between the crank arm 121 and the second actuating link 132 is adjusted.

Therefore, as shown in FIG. 2, the lengths of the trajectories A and B of the pedals 60 and the arm levers 50 can be adjusted. Thus, the length of the exercise trajectory can be adjusted depending on the height of the user or the length of the arms of the user.

Here, the above-mentioned construction of the length adjustment means is only one representative example, and various modifications or substitutions thereof are possible.

13) First Actuating Link 131 and Second Actuating Link 132

Each of the two first actuating links 131 is integrally coupled to the corresponding pedal link 80 at a predetermined angle. Each of the two second actuating links 132 is integrally coupled at both ends thereof to the corresponding first actuating link 131 and the corresponding crank arm 121 of the crank 120.

Although the first actuating link 131 is integrally coupled to the pedal link 80 at a predetermined angle, an interior angle between the first actuating link 131 and the pedal link 80 can be adjusted by an angle adjustment means.

In the angle adjustment means, a first end of a first actuating link 131 is coupled to the corresponding pedal link 80 through the single shaft 13.

The angle adjustment means includes a plurality of coupling protrusions 131*a*, which are provided on the first end of the first actuating link 131 and are arranged around the center of the first end of the first actuating link 131 in the circumferential direction, and a plurality of coupling holes 81, which are formed in the second end of each pedal link 80, and into which the respective coupling protrusions 131*a* of the first actuating link 131 are inserted.

The angle adjustment means further includes a coupling means 133, which is coupled to the shaft 13 of the base 10, which is disposed at the center among the coupling protrusions 131*a* inserted into the respective coupling holes 81.

Here, preferably, a bearing (not shown) is interposed between the shaft 13 of the base 10 and each pedal link 80 to prevent noise attributable to friction and ensure smooth rotation.

Due to this construction, the angle between each pedal link 80 and the corresponding first actuating link 131 can be adjusted by changing the position at which the coupling protrusions 131*a* of the first crank link 131 are inserted into the respective coupling holes 81 of the pedal link 80, after the coupling means 133 is loosened.

Thereby, as shown in FIGS. 2 and 7, the position of the trajectory A of the pedals 60 can be adjusted. As a result, various exercise effects according to the position adjustment can be obtained.

Meanwhile, the ultimate purpose of the adjustment in the angle between the pedal links 80 and the first actuating links 131 by using the angle adjustment means is to move the position of the trajectory of the pedals 60.

For example, when the angular range of the trajectory of the pedals 60 is 40°, the trajectory of the pedals 60 may be within a range from 0° to 40° relative to the ground, or, alternatively, may be within a range from 30° to 70° relative to the ground. As a further alternative, the trajectory of the pedals 60 may be within a range from 50° to 90° relative to the ground.

Depending on the position of the trajectory of the pedals 60, the posture of the user when exercising and the used muscles vary, thus obtaining different exercising effects.

Furthermore, the above-mentioned construction of the angle adjustment means is only one representative example, and various modifications or substitutions thereof are possible.

The operation of the pedal exercise machine according to the present invention will be explained with reference to FIGS. 12 through 14.

When the user holds the handle 51 of the arm lever 50 and pulls it towards his/her body, an interior angle between the first lever link 72 and the second lever link 73 of the lever link unit 70 is reduced and the second lever link 73 moves forwards.

Simultaneously, the pedal link 80 which is coupled to the second lever link 73 through the pedal shaft 62*a* is rotated forwards around the shaft 13 of the base 10.

As a result, the pedal 60 moves along the inclined arc trajectory, as shown in FIGS. 12 through 14.

As described above, in a pedal exercise machine having an arc trajectory according to the present invention, a user can conduct not only lower body exercise using pedals which move along a pedal trajectory similar to the trajectory of the feet of a person when climbing a slope or stairs but also upper body exercise using arm levers which are operated in conjunction with the pedals having the above trajectory. In other words, the present invention enables the user to exercise all parts of the body.

In addition, in the present invention, stationary handles are provided at various positions, so that the degree of freedom of the posture of the user is increased, thus providing an effect similar to, for example, climbing a slope or riding a bicycle in a standing position.

As well, depending on the adjustment of the exercise load, a desired effect, for example, of strengthening cardiopulmonary endurance, reducing body fat, or of strengthening muscular power, can be obtained. In other words, when the exercise load is relatively low, the effect of an aerobic exercise machine can be obtained. When the exercise load is relatively high, an effect of an exercise for strengthening muscular power can be obtained.

Moreover, using a displacement means, an angle adjustment means and a length adjustment means, the present invention enables the user to change the parts of the body to be exercised, thus providing various exercise effects.

That is, to provide various exercise effects, the present invention includes the displacement means and the length adjustment means for adjusting the angle of the pedals relative to the ground, the length adjustment means for increasing or reducing the length of the trajectories of the pedals and the lever arms in consideration of the height of the user and the length of the arms of the user, and the angle adjustment means for adjusting the position of the trajectory of the pedals. Thereby, the pedal exercise machine having the arc trajectory according to the above-mentioned objects of the present invention can be realized.

Although the pedal exercise machine according to the preferred embodiment, having a special shape and construction, has been disclosed for illustrative purposes with reference to the attached drawings, those skilled in the art will appreciate that various modifications, additions and substitutions are possible. Furthermore, such modifications, additions and substitutions must be interpreted as falling within the scope and spirit of the invention as disclosed in the accompanying claims.

What is claimed is:

1. A pedal exercise machine having an arc trajectory, comprising:

a base;

a front frame and a center frame provided on the base, the front frame and the center frame being coupled to each other;

a pair of pedals to move upwards and downwards in alternating directions;

a pedal link for connecting each of the pedals to the base;

a pair of arm levers coupled to the front frame so as to be rotatable in alternating directions;

a pair of lever link units each having a first lever link coupled at a first end thereof to the corresponding arm lever, and a second lever link connecting a second end of the first lever link to the corresponding pedal, the second lever link being coupled to the pedal by a first shaft that couples the corresponding pedal link to the corresponding pedal;

a pair of subsidiary pedal links connecting the pedal to the center frame, each of the subsidiary pedal link being coupled to the corresponding pedal by a second shaft different from the first shaft, through which the corresponding pedal link is coupled to the pedal;

a resistance pulley provided in the center frame;

a crank having crank arms coupled to the resistance pulley through a crank shaft;

a first actuating link integrally coupled to each of the pedal links at a predetermined angle; and a second actuating link rotatably coupled at both ends thereof to the first actuating link and the corresponding crank arm of the crank.

2. The pedal exercise machine as set forth in claim 1, wherein the first actuating link has angle adjustment means for adjusting an angle between the first actuating link and the corresponding pedal link around a base-side shaft of the pedal link.

3. The pedal exercise machine as set forth in claim 1, wherein each of the crank arms of the crank has length adjustment means.

4. The pedal exercise machine as set forth in claim 1, wherein each of the subsidiary pedal links has displacement means for displacement thereof relative to the corresponding pedal.

5. The pedal exercise machine as set forth in claim 4, wherein the displacement means is constructed such that an angle of the pedal relative to a ground varies depending on a position, at which the subsidiary pedal link is coupled to the center frame, the pedal, or both the center frame and the pedal.

6. The pedal exercise machine as set forth in claim 4, wherein the displacement means is constructed such that the subsidiary pedal link comprises two separate bodies coupled to each other so as to be adjustable in length.

7. The pedal exercise machine as set forth in claim 5, wherein the displacement means is constructed such that the subsidiary pedal link comprises two separate bodies coupled to each other so as to be adjustable in length.

* * * * *